US006435930B1

(12) United States Patent
Higgins

(10) Patent No.: US 6,435,930 B1
(45) Date of Patent: Aug. 20, 2002

(54) BASKETBALL COIN BANK

(76) Inventor: David W. Higgins, 421 W. Robinson, Lowell, AR (US) 72745

( * ) Notice: Subject to any disclaimer, the term of this patent is extended or adjusted under 35 U.S.C. 154(b) by 0 days.

(21) Appl. No.: 09/993,142

(22) Filed: Nov. 5, 2001

(51) Int. Cl.[7] ..... A63H 33/00
(52) U.S. Cl. ..... 446/12; 206/0.81; 206/0.815
(58) Field of Search ..... 446/8, 9, 10, 11, 446/12, 13, 71; 206/0.8, 0.81, 0.815

(56) References Cited

U.S. PATENT DOCUMENTS

| | | | | | |
|---|---|---|---|---|---|
| 180,574 | A | | 8/1876 | Gould | 446/12 |
| 232,699 | A | | 9/1880 | Eddy | 446/12 |
| 376,628 | A | | 1/1888 | Bowen | 446/11 |
| 385,225 | A | | 6/1888 | Bailey | 446/11 |
| 1,461,821 | A | | 7/1923 | Eberhardt et al. | 446/12 |
| 1,658,378 | A | | 2/1928 | Hensel | 446/12 |
| 2,448,951 | A | | 9/1948 | Baum | 446/12 |
| 5,282,765 | A | * | 2/1994 | Suzuki | 232/1 D |
| D379,025 | S | | 4/1997 | Panek | D99/39 |
| 5,697,828 | A | | 12/1997 | Smathers et al. | 446/11 |
| D403,834 | S | | 1/1999 | Nulman | D99/37 |
| 6,109,996 | A | * | 8/2000 | Ma et al. | 446/8 |
| 6,171,167 | B1 | * | 1/2001 | Perkitny et al. | 446/8 |

FOREIGN PATENT DOCUMENTS

WO PCT/US88/04404 12/1988

* cited by examiner

*Primary Examiner*—Jacob K. Ackun
(74) *Attorney, Agent, or Firm*—Locke Liddell & Sapp LLP; Monty L. Ross

(57) ABSTRACT

A toy bank having a base structure to store coins. A basketball player is mounted above the base structure, the basketball player having a coin holder generally shaped as a basketball. After the coin is placed in the coin holder, a lever arm is pushed thereby operating a rotation mechanism to cause the basketball player to elevate, rotate and pivot its arms to deliver the coin to a coin receptacle. The coin receptacle resembles a basketball goal and is designed to receive and direct the coin inside the base structure. Thus, when the lever arm is pressed, the toy bank simulates a basketball player shooting or "dunking" a basketball.

14 Claims, 4 Drawing Sheets

BASKETBALL COIN BANK

TECHNICAL FIELD

The present invention relates generally to coin banks and more particularly to a toy basketball coin bank.

BACKGROUND OF THE INVENTION

Many coin banks exist to encourage saving coins; however, none simulates a basketball player that elevates, rotates and dunks a basketball that carries a coin for depositing into a bank. For example, U.S. Pat. No. 180,574 entitled "Toy Money-Box" discloses an android having a movable arm that pivots to deliver a coin into the coin bank while at the same time removing its hat and tilting its head. Other patents such as U.S. Pat. Nos. 232,699, 376,628, 385,225, 1,461,821, 7,658,378 and 2,448,951 all disclose human figures and/or animals that move to deposit coins inside a coin receptacle. U.S. Pat. Nos. 5,697,828, D379, 025, D403,834 and PCT Application No. PCT/US88/04404 also disclose coin banks. However, none of these coin banks exhibits a jumping, rotating and shooting basketball player delivering a coin into a simulated basketball goal.

SUMMARY OF THE INVENTION

This invention relates to a toy basketball coin bank. The coin bank includes a base to store coins and has a top surface to simulate a portion of a basketball court. A basketball goal is attached to the base and functions as a coin receptacle to receive and direct coins into a coin storage area. A basketball player holding a basketball is mounted above the base on a pole and delivers coins to the basketball goal. During use, coins are first placed in a holding slot located on the basketball. A lever extending out of the base is pressed causing the basketball player to jump, pivot to face the basketball goal and rotate its arms toward the basket to deliver the coin to simulate a "slam dunk." When the ball tips over the basket, the coin falls into a slot that directs the coins down to a coin storage area inside the base. Upon release of the lever, the player retracts back to its original position and is ready for the next coin to be deposited.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DESCRIPTION OF THE PREFERRED EMBODIMENTS

Figure 1:
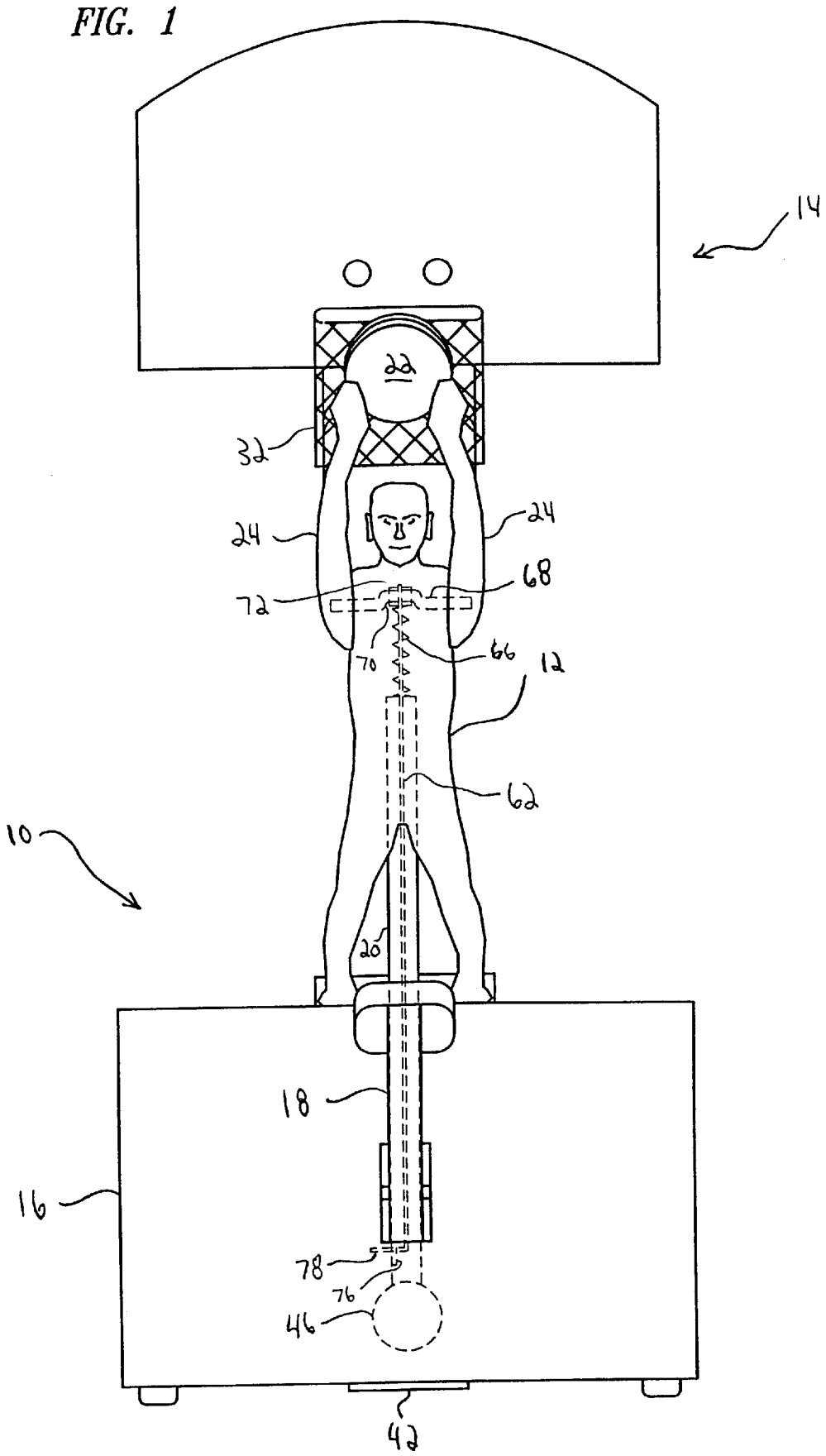
FIG. 1 is a front elevation view of the basketball coin bank showing the basketball player in the retracted position.
Figure 2:
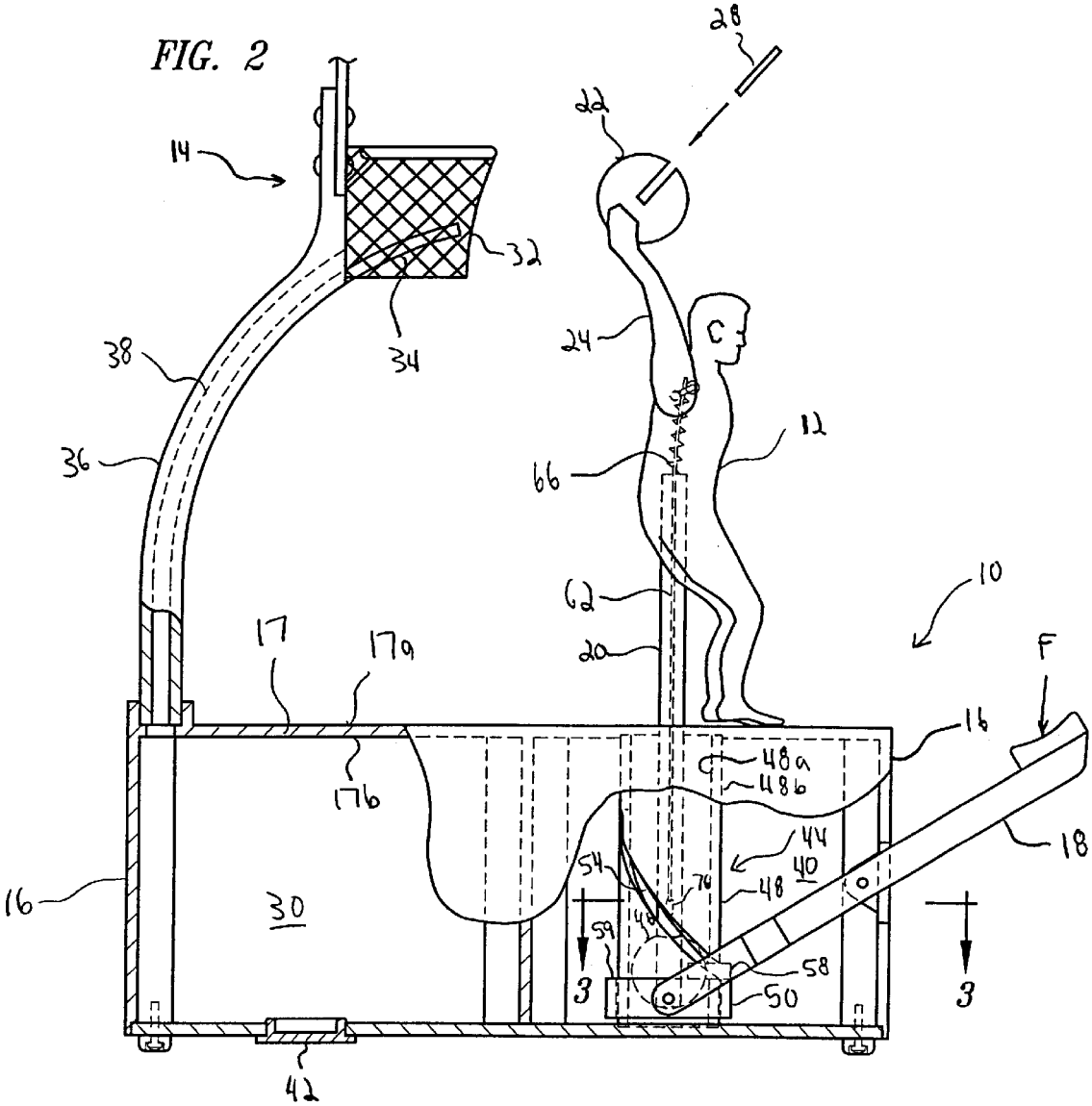
FIG. 2 is a side elevation view of the basketball coin bank of FIG. 1.

Toy basketball coin bank 10 simulates a basketball player jumping, pivoting and dunking a coin into a receptacle shaped as a basketball goal. Referring to FIGS. 1 and 2, basketball coin bank 10 preferably comprises a human figure or basketball player 12, a basketball goal 14, a base structure 16 and a lever arm 18.

Referring specifically to FIG. 2, basketball player 12 can be seen mounted on a pole 20 in a retracted position. While in the retracted position, player 12 is positioned with his back toward basket 14 and holds a basketball 22 above his head. In this position, a user can place a coin 28 in slot 26 to hold and support coin 28 for depositing into bank 10. Player 12 is then simultaneously elevated and rotated from the retracted position to a shooting position, as best seen in FIG. 4, so that player 12 is facing the basket, with arms 24 rotated downwardly toward basketball goal 14.

Referring to FIG. 2, basketball goal 14 is attached above base 16 and directs coin 28 through feed slot 38 into a collection area 30. Goal 14 preferably further comprises a basket 32, orienter plate 34, support 36 and feed slot 38, all operable to direct coins into collection area 30. In operation, coin 28 is deposited into basket 32, where it is oriented by plate 34 so that it will lie flat and fall into feed slot 38. Feed slot 38 is located in basketball goal support 36 and gradually curves so that coin 28 will travel downward from the basket into collection area 30 without lodging inside slot 38. Base structure 16 includes a top surface 17, having an upper boundary 17*a* simulating a portion of a basketball court, and a lower boundary 17*b*, a coin collection area 30 and a rotation mechanism compartment 40. Deposited coins are stored in area 30 and remain there until the user desires to empty the bank. Storage area 30 is emptied by removing cover 42 and shaking the coins out through the opening.

Figure 3:
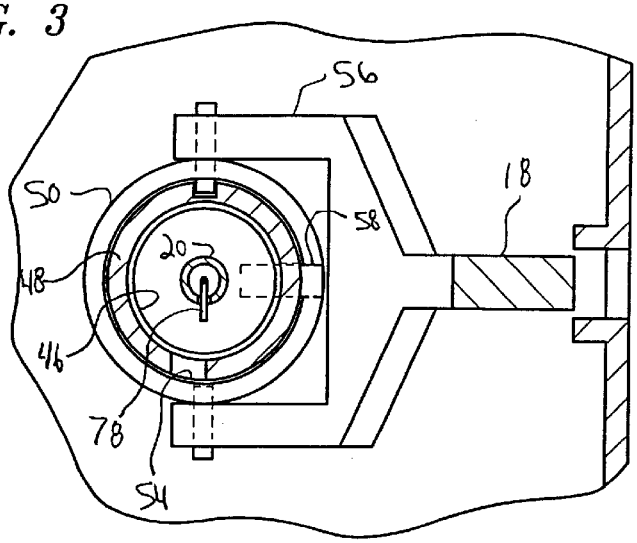
FIG. 3 is a section view taken along the 3—3 in FIG. 2.
Figure 4:
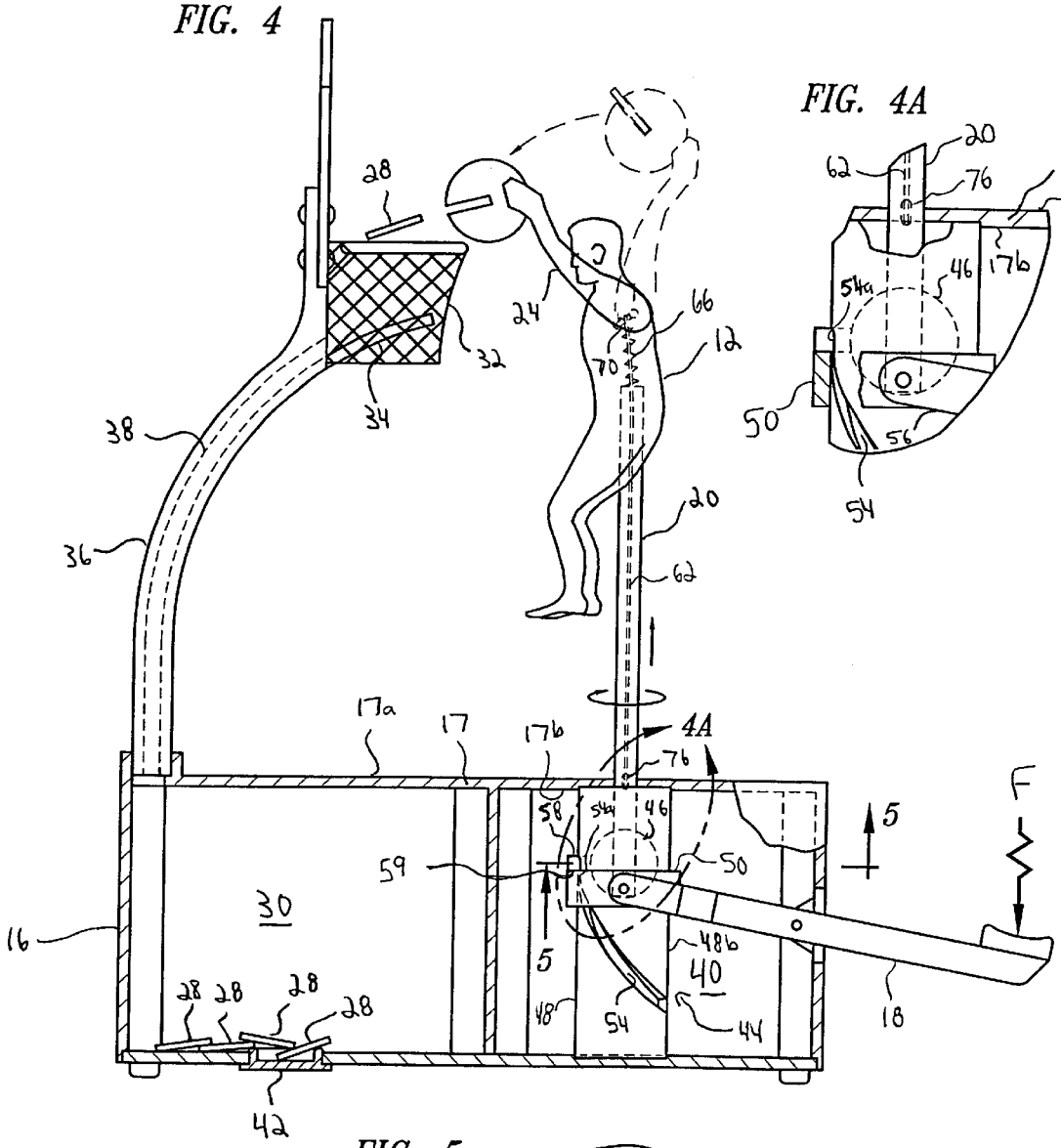
FIG. 4 is a side elevation view as seen in FIG. 2 showing the basketball player fully elevated and rotated, with arms in the dunking position.

Referring more specifically to rotation mechanism compartment 40 in FIGS. 2 and 4, a rotation mechanism 44 causes player 12 to jump, pivot and rotate its arms simultaneously. Rotation mechanism 44 comprises pole 20, preferably tubular, connected to a spherical base 46, which is raised and lowered inside a hollow tube 48 by lever arm 18. Ring 50 surrounds hollow tube 48, having an inner surface 48*a* and outer surface 48*b* (FIG. 4), creating a slidable interface 52 with tube outer surface 48*b*. The sidewall of hollow tube 48 includes a spiraling slot 54 extending upward and 180 degrees around the outer surface of tube 48. Referring to FIGS. 2–4, ring 50 is connected to lever 18 by fork 56 and is raised along outer tube surface 48*b* by applying a downwardly directed force F to lever 18.

Sphere 46, positioned freely inside tube 48, has a diameter slightly smaller than the inner diameter of tube 48 to allow sliding engagement between sphere 46 and tube inner surface 48*a*. Sphere 46 further comprises a pin 58, which protrudes horizontally outward from sphere 46 to slidably engage slot 54, as seen in FIGS. 2 and 4. Pin 58 extends beyond tube outer surface 48*b* and rests on ring top surface 59, as best seen in FIGS. 3 and 4. The diameter of pin 58 is slightly smaller than the width of slot 54 to permit the pin to slide freely inside slot 54.

Player 12 pivots and elevates in response to pressing lever 18. When lever 18 is pressed downward, fork 56 lifts ring 50, thereby causing pin 58 to slide upward along the length of spiraled slot 54. As pin 58 slides inside slot 54, sphere 46 rotates and travels upward inside hollow tube 48. Because the body of player 12 and pole 20 are attached in fixed relation to sphere 46, player 12 elevates and rotates to simulate a jump and pivot as lever 18 is depressed to raise and rotate sphere 46. As pin 58 travels along slot 54 to reach a position removed 180 degrees around tube 48 from the starting position, player 12 faces basket 14 and is in the shooting position, as seen in FIG. 4.

Figure 6:
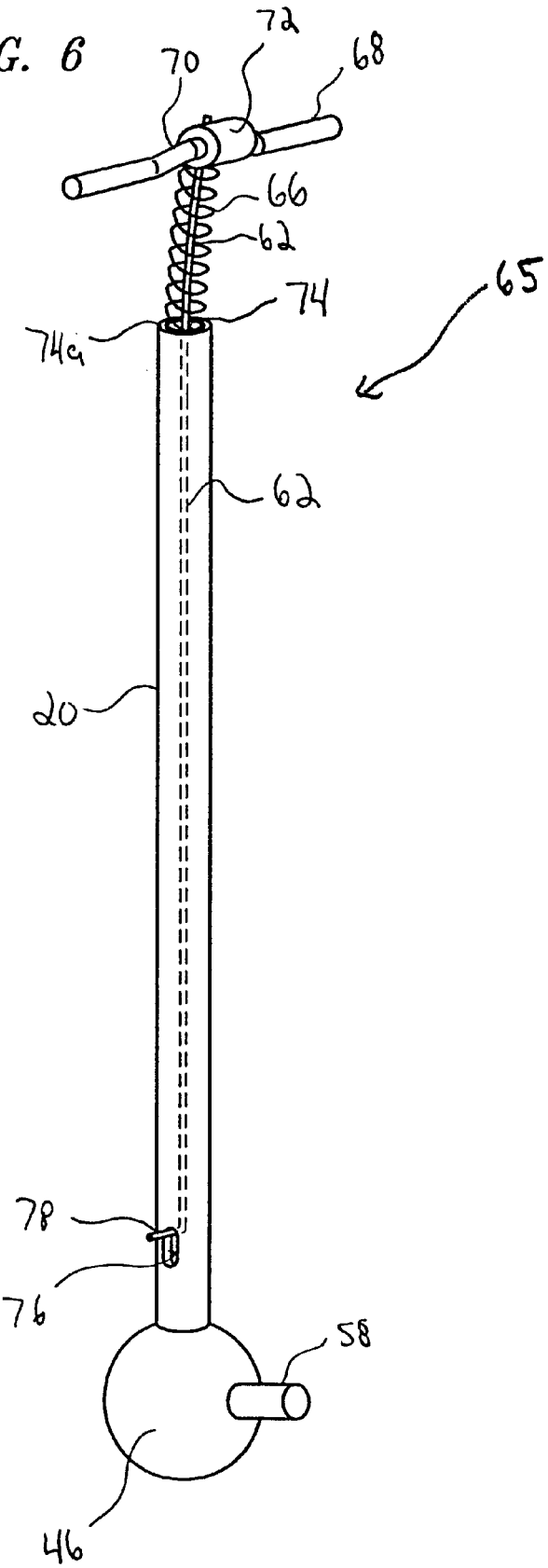
FIG. 6 is a perspective view of a portion of the rotation mechanism.

Once player 12 is in the shooting position, arms 24 are rotated toward basket 32 by arm rotation mechanism 65, as best seen in FIG. 6. Rotation mechanism includes a rotating pin 68, which pivotably connects arms 24 to player 12 (FIG. 1). Arm rotation mechanism 65 further includes pole 20, a biasing mechanism or spring 66, a side slot 76 and rod 62. Pin 68 extends across the shoulder width of player 12 having an offset bend 70 most preferably "u" shaped. As seen in FIG. 6, rod 62 attaches to pin 68 via a connecting mechanism 72, which is preferably a sleeve, ring or hook welded or glued onto the end portion of rod 62. Rod 62 is inserted through circular opening 74 on pole top surface 74a to extend inside pole 20. Rod 62 extends downward through the hollow interior of pole 20 until reaching side slot 76 where rod 68 bends horizontally to form a horizontal extension 78 extending through slot 76. Rod 68 is most preferably a thin flexible wire fabricated from metal or plastic.

Figure 4A:
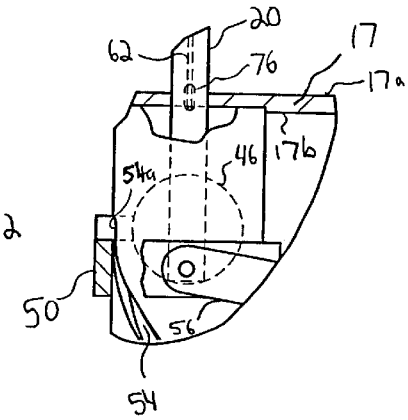
FIG. 4A is a side elevation view of the area enclosed by line 4A indicated in FIG. 4 showing the pole side slot and pin engaged in the tube slot.
Figure 5:
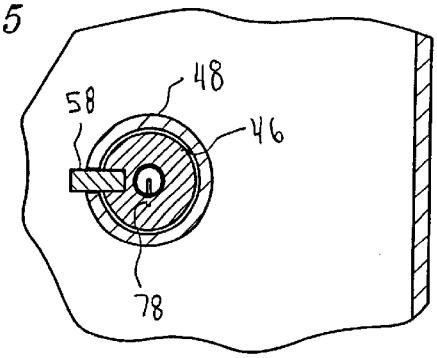
FIG. 5. is a section view taken along line 5—5 in FIG. 4.

Referring to FIGS. 4 and 4A, player 12 can be seen facing basket 14. Upon player 12 reaching this position, lever 18 is pressed further so that pin 58 travels directly upward along slot portion 54*a* raising pole 20 so that horizontal extension 78 engages lower boundary 17*b*. As extension 78 engages lower boundary 17*b*, rod 62 is prevented from moving upward along with pole 20. Slot 76 allows pole 20 to slide relative to extension 78 so that the pole can continue to move upward while rod 62 remains stationary. This relative motion allows rod 62 to pull downward on offset portion 70 creating a moment to rotate pin 68 and arms 24 counterclockwise until basketball 22 deposits coin 28 into basket 32, as seen in FIG. 4. The movement between pole 20 and rod 62 compresses spring 66, located between connecting mechanism 72 and top surface 74*a*, so that upon release of lever 18 the force provided by the compressed spring rotates arms 24 clockwise until the spring returns to its static length. When spring 66 reaches its static length, arms 24 are returned above the player's head and player 12, pole 20 and sphere 46 continue to fall downwardly, causing pin 58 to slide back down slot 54, thereby pivoting player 12 back to the rearward facing or retracted position.

Although the preferred embodiments of the present invention have been illustrated in the accompanying Drawings and described in the foregoing Detailed Description, it will be understood that the invention is not limited to the embodiments disclosed but is capable of numerous rearrangements, modifications and substitutions of parts and elements without departing from the spirit of the invention.

I claim:

1. A toy bank comprising:

a base structure having a top surface, a first area and a second area whereby said first and second areas are located beneath said top surface;

a coin collection area located inside said first area to store coins;

a coin receptacle located above said top surface to receive the coins and direct the coins into said coin collection area;

a model human figure mounted on said top surface having pivoting arms, a slot to receive and hold at least one coin on said pivoting arms; and a lever connected to a rotation mechanism located inside said second area wherein when said lever is pressed said human figure elevates, rotates 180 degrees and pivots its arms in a continuous motion to set the coin into said coin receptacle.

2. The toy bank of claim 1, wherein said coin receptacle is shaped as a basketball goal.

3. The toy bank of claim 1, wherein said model human figure is an imitation basketball player.

4. The toy bank of claim 1, wherein said slot to receive and hold said a coin is shaped as a basketball.

5. A toy bank comprising:

a base structure having a top surface and a coin collection area;

a human figure mounted above said top surface comprising a pair of pivoting arms connected by a rotating pin and a mechanism to receive and support a coin;

a coin receptacle to receive and direct coins into said coin collection area;

a rotation mechanism located in said base structure causing said human figure to elevate and rotate from a retracted position to a shooting position and to pivot said arms to deposit said coin into said coin receptacle, the rotation mechanism comprising a vertical hollow tube having an inner and outer surface, a curved slot on said tube whereby said slot spirals upward and 180 degrees around said tube, a spherical body located inside and slidably engaging said tube inner surface wherein said sphere further has an outwardly protruding pin to slidably engage and extend through said slot and over a ring, wherein said ring engages around said tube outer surface and a lever arm connected to said ring wherein a force applied to the lever arm causes said ring to move upward along said tube outer surface and push said pin along said slot to rotate and raise said spherical body;

a tubular pole having a first end, a second end and a side slot located between said first and second end, wherein said first end connects to said human figure and said second end connects to said spherical body wherein said pole is raised and rotated with said spherical body; and a rod having a first end and a second end, wherein said first end contains a connecting mechanism to connect said first end to said rotating pin and said second end extends inside said pole and contains a horizontal extension extending through said side slot whereby when said pole is rotated 180 degrees from said retracted position to said shooting position and travels further upward along said slot, said extension engages said base structure top surface and prevents said rod from moving upward with said pole creating a relative movement between said rod and pole so that said rod pulls downward on said rotating pin to pivot said arms from a first position to a second position to deposit said coin into said coin receptacle.

6. The toy bank of claim 5, wherein said human figure is a basketball player.

7. The toy bank of claim 5, wherein said coin receptacle is a simulated basketball goal.

8. The toy coin bank of claim 5, wherein said mechanism to receive and hold a coin is a simulated basketball.

9. The toy coin bank of claim 8, wherein said simulated basketball comprises a slot to hold the coin.

10. The toy coin bank of claim 5, wherein said top surface simulates a portion of a basketball court.

11. The toy coin bank of claim 5, wherein said connecting mechanism is a ring.

12. The toy coin bank of claim 5, wherein said connecting mechanism is a hook.

13. The toy coin bank of claim 5, wherein said coin collection area further comprises an opening to empty said coins.

14. The toy coin bank of claim 5, wherein when said rod pulls downward on said rotating pin, a biasing mechanism is compressed between said pole and said connecting mechanism wherein upon release of said lever said biasing mechanism provides a force to rotate said arms upward to said first position and cause said pin to slide down said slot thereby pivoting said player to the retracted position.

* * * * *